US006329616B1

(12) United States Patent
Lee

(10) Patent No.: US 6,329,616 B1
(45) Date of Patent: Dec. 11, 2001

(54) POWER CONTROL APPARATUS

(76) Inventor: Jae Ha Lee, 5-1102 Wooseong APT 42 Myoungill2-dong, Kandong-ku, Seoul (KR)

( * ) Notice: Subject to any disclaimer, the term of this patent is extended or adjusted under 35 U.S.C. 154(b) by 0 days.

(21) Appl. No.: 09/655,333

(22) Filed: Sep. 5, 2000

Related U.S. Application Data

(63) Continuation-in-part of application No. 09/255,133, filed on Feb. 19, 1999, now abandoned.

(30) Foreign Application Priority Data

Feb. 10, 1998 (KR) ..... 98-1563
Jul. 4, 1998 (KR) ..... 98-12199

(51) Int. Cl.[7] ..... H01R 29/00

(52) U.S. Cl. ..... 200/51.03; 200/51 R; 200/51.08; 439/188; 439/655

(58) Field of Search ..... 191/12.4; 200/50.28, 200/51 R, 51.02–51.05, 51.11; 307/40, 41, 141; 361/111, 115, 116; 174/48, 70, 135; 439/650–654, 954, 535, 207–211, 214, 218, 620, 622, 761, 101, 108, 52, 188, 501, 502

(56) References Cited

U.S. PATENT DOCUMENTS 5,236,374 * 8/1993 Leonard et al. ..... 439/505
5,350,310 * 9/1994 Chen ..... 439/188
5,424,903 * 6/1995 Schreiber ..... 361/166
5,429,518 * 7/1995 Chen ..... 439/188
5,430,598 * 7/1995 Rodolfo et al. ..... 361/115
5,788,521 * 8/1998 Milan ..... 439/214
5,844,326 * 12/1998 Proctor et al. ..... 307/34

* cited by examiner

*Primary Examiner*—Michael Friedhofer
(74) *Attorney, Agent, or Firm*—Nathan N. Kallman

(57) ABSTRACT

A power control apparatus, for directing an electrical power from a power source to a selected electrical appliance, includes a switch box having a plurality of activating switches and a main switch for controlling the flow of power to the switches, a unit for supplying power connected directly to the switch box and to the main switch without any intervening electrical outlets, and a plurality of conductor lines, each connected individually within the switch box to a respective one of the plurality of the switches and extending from the switch box, the ends of the conductor lines having connecting holes for a direct connection to the electrical appliances without any intervening switches, the switches and conductor lines being integrally formed with the switch box.

10 Claims, 8 Drawing Sheets

POWER CONTROL APPARATUS

This application is a continuation-in-part of application 09/255,133, filed on Feb. 19, 1999, now abandoned.

BACKGROUND OF THE INVENTION

1. Field of the Invention

The present invention relates to a power control apparatus, and in particular to an improved power control apparatus which is capable of minimizing power consumption and a harmful electrical wave and continuously maintaining a currently set state of each switch before the state of a switch is changed.

2. Description of the Background Art

Generally, a power control apparatus is installed on a wall of a house or is displayed on a floor of the house. A plug of a certain electrical appliance is connected with a port of the power control apparatus for thereby effectively controlling the power of an electrical appliance.

However, in the case that the number of connection ports of the power control apparatus (wall outlet) is small compared to the number of electrical appliances, or in the case that the electrical appliance is remote from the power control apparatus, as shown in FIG. 1, a multi-port power control apparatus is generally used.

As shown in FIG. 1, when a plug 10 is connected with a wall outlet, power is applied to each port 20 of the power control apparatus for thereby providing the power to a selected electrical appliance.

In case that the electrical appliance is not used, when the plug is connected with the port 20 of the power control apparatus, the power is continuously applied to the electrical appliance for thereby resulting in power consumption. In this case, a harmful electrical wave may be generated thereby causing a malfunction of the electrical appliance.

In addition, in order to remove the power remaining on a conductor line, each plug is disconnected from the outlet thereby causing inconvenience.

In the above case, a switch 30 is installed for turning on/off the power at one time. When the electrical appliance is not to be used, the switch 30 is turned off thereby disconnecting the power. Therefore, it is not necessary to disconnect the plug of the electrical appliance from the port 20 of the power control apparatus.

At this time, when the switch 30 is turned off, a plurality of ports 20 of the power control apparatus are disconnected, so that all appliances connected with the power control apparatus are disconnected from the power. In addition, in the case that the switch 30 is turned on, the power is supplied to the appliances which are currently used. However, in this case, the power is supplied to the appliances which are not used. Therefore, power consumption is increased, and the harmful electrical waves are generated.

In addition, in order to use the multiple-port power control apparatus, the plug is externally installed at the electrical appliance, so that an outer appearance of the product is bad. In addition, a foreign material such as a metal piece may be accidentally inserted into the power control apparatus thereby causing a short circuit.

The set state may be changed by a external cause after the switch 20 is turned on/off.

Namely, since the switch is externally formed, if a person unintentionally touches the switch, the switch may be turned on/off thereby causing an error.

For example, when a user uses the computer, the user may unintentionally touched the switch thereby turning off the computer, so that data is lost.

As another example, in the case that a worker may unintentionally touch the switch and turn off the switch at a work place such as a factory or a construction site, the set switch may be changed thereby causing an undesirable accident.

SUMMARY OF THE INVENTION

Accordingly, it is an object of the present invention to provide a power control apparatus which is capable of separately supplying power to a corresponding one of the multiple ports of the power control apparatus.

It is another object of the present invention to provide a power control apparatus in which a plurality of ports of the power control apparatus are spaced-apart at a regular interval using an extended conductor line.

It is another object of the present invention to provide a power control apparatus which is capable of stably maintaining a set state of a corresponding switch.

To achieve the above objects, there is provided a power control apparatus for directing an electrical power from a power source to a selected electrical appliance which includes a switch box including a plurality of activating switches for supplying power to a selected electrical and including a main switch the controlling the flow of power to the switches, a unit for supplying power connected directly to the switch box and to the main switch without any intervening electrical outlets, and a plurality of conductor lines, each connected individually within the switch box to a respective one of the plurality of the switches and extending from the switch box, the ends of the conductor lines having connecting holes for a direct connection to the electrical appliance without any intervening switches, the switches and conductor lines being integrally formed with the switch box.

A plurality of outlets is formed in the switch box, each connected individually to a respective one of the plurality of the switches within the switch box, each outlet being connectable directly to a selected one of the electrical appliances without any intervening switches, the switches and conductor lines being integrally formed with the switch box.

BRIEF DESCRIPTION OF THE DRAWINGS

The invention will be described in greater detail with reference to the accompanying drawings wherein.

DETAILED DESCRIPTION OF THE PREFERRED EMBODIMENTS

The embodiments of the present invention will be explained in detail with reference in FIGS. 2 and 3.

Figure 1:
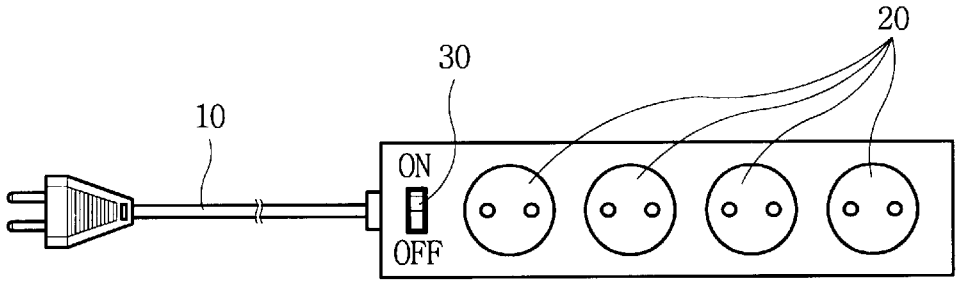
FIG. 1 (PRIOR ART)
FIG. 1 is a plan view illustrating a conventional power control apparatus.
Figure 2:
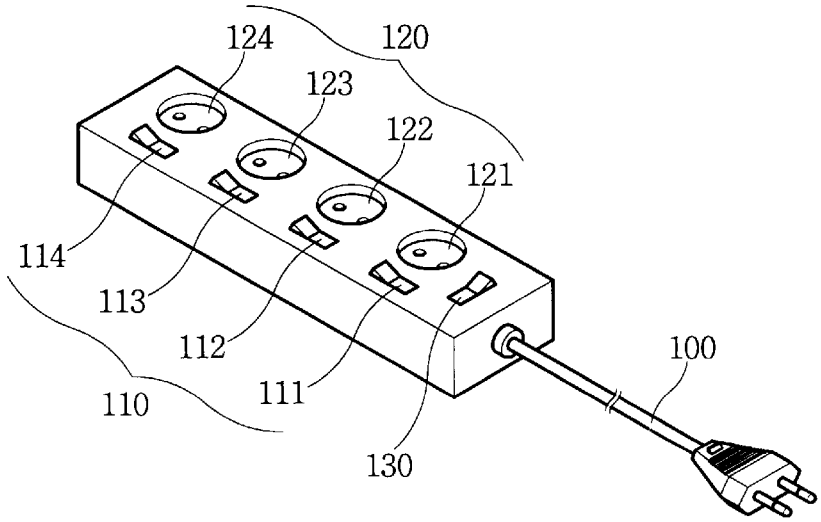
FIG. 2 is a perspective view illustrating an outer appearance of a power control apparatus according to a first embodiment of the present invention.

FIG. 2 is a view illustrating an outer appearance of the first embodiment of the present invention in which a switch unit 110 formed of a plurality of switches is installed to respectively correspond with one of the ports of the port unit 120 based on a one-to-one match.

When a plug of a power supply line 100 is inserted into an outlet, when one of the switch unit 110 corresponding to one of the ports of the port unit 120 is turned on, the power is supplied to only one port of the port unit 120 corresponding to the turned-on switch.

Figure 3:
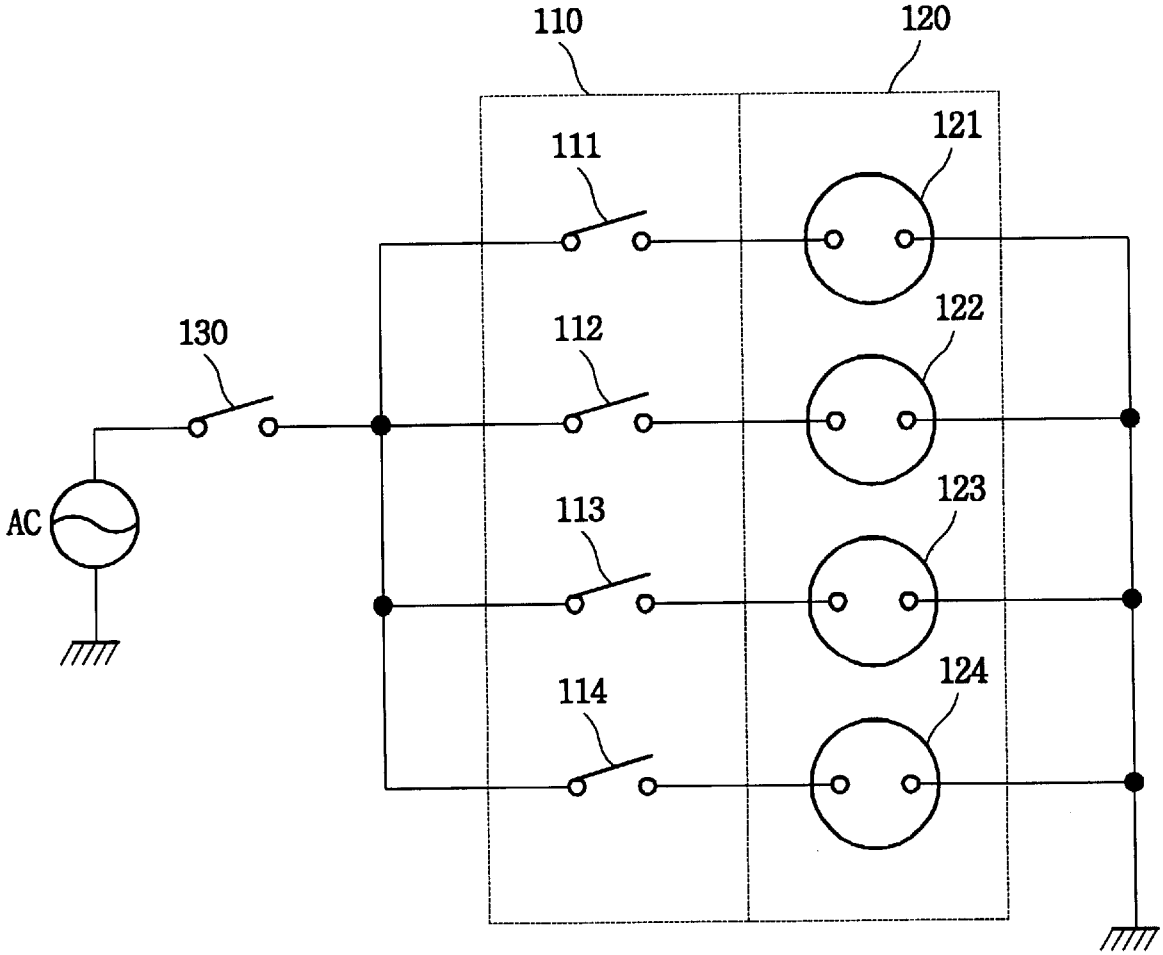
FIG. 3 is a schematic view illustrating an inner circuit construction according to the present invention.

As shown in FIG. 3, one terminal of the switches 111, 112, 113 and 114 of the switch unit 110 is parallel connected with the power AC, and the other terminal of each of the switches 111, 112, 113 and 114 is connected with one terminal of the ports 121, 122, 123 and 124 of the port unit 120 based on a serial connection, and the other terminal of each of the ports 121, 122, 123 and 124 is connected with the ground (negative terminal).

When the user separately turns on the switch 111 of the switch unit 110, the power is supplied to the port 121 of the port unit 120 which is connected in series.

At this time, even when the plug which is not currently used is inserted into one of the ports 122, 123 and 124, since the switches 112, 113 and 114 are turned off, the power supply is disconnected, so that it is possible to prevent a power consumption due to the remaining current.

When the user turns on the switch corresponding to the port into which the plug of the electrical appliance is inserted, the power AC is applied to the port, so that it is possible to use the electrical appliance.

Therefore, only the switch corresponding to the port is turned on, and the power AC is supplied and the power is disconnected from the other ports.

There is further provided a main switch 130 which is capable of turning on/off the port unit 120 at one time formed of a plurality of ports.

In addition, the main switch 130 is provided in series between the power AC and the switch unit 110. Therefore, even when the switches 111, 112, 113 and 114 of the switch unit 110 are turned on, the power is not supplied to the port unit 120 by turning off the main switch 130.

For example, in a state that a plurality of the plugs of the electrical appliances are inserted into the port unit 120 formed of a plurality of ports 121, 122, 123 and 124, when the switches 111, 112, 113 and 114 of the switch unit 110 are turned on, only the main switch 130 is turned for supplying the ports 121, 122, 123 and 124. Therefore, it is possible to integrally control the system.

In the case that the power is not concurrently applied to the port unit 120, it is possible to disconnect the power at one time by turning off the main switch 130.

The switches 111, 112, 113 and 114 of the switch unit 110 and the main switch 130 may be formed of a multiple-port switch for effectively disconnecting the remaining current due to the negative current.

Figure 4:
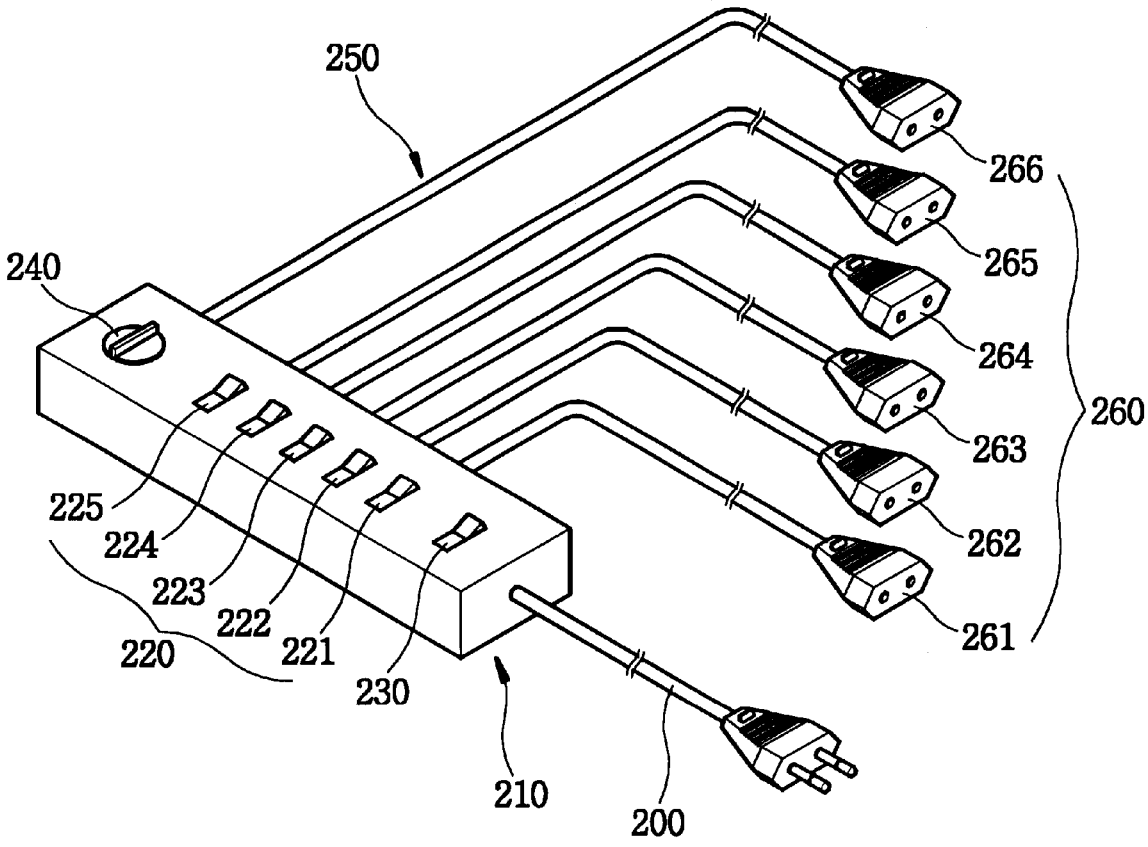
FIG. 4 is a perspective view illustrating a power control apparatus according to a second embodiment of the present invention.

FIG. 4 is a view illustrating the power control apparatus according to the second embodiment of the present invention. As shown therein, there are provided a switch box 210 integrally formed with a switch unit 220 formed of a plurality of switches for separating the power supplied from the power supply line 200 and separately supplying the power to a plug unit 260 formed of a plurality of plugs, an extended line 250 for supplying the power supplied from the switch box 210 to the plug unit 260, and the plug unit 260 for supplying the power connected by the extended line 250 to each electrical appliance.

In addition, there is provided a main switch 230 for disconnecting the power applied to the switch unit 220 through the power supply line 200.

A timer may be provided for turning on and off the switch unit 220 or the main switch 230 based on a set time.

The second embodiment of the present invention will be explained with reference to FIGS. 4 and 5.

As shown therein, in the power control apparatus according to another embodiment of the present invention, the power supply line 200 having a plug connection port is parallel connected with the switch unit 220 formed of a plurality of switches of the switch box 210, and the switch unit 220 is connected with the plug unit 260 formed of a plurality of plugs spaced apart from the switch box 210 by the extended lines 250, so that the power is applied to the plug unit 260 by a switching operation of the switch unit 220. A main switch 230 is installed at the switch box 210 for connecting and disconnecting the power applied to the switch unit 220 through the power supply line 200.

Therefore, when the plug is inserted into the outlet installed on the wall or the floor, the main switch 230 of the switch box 210 is turned on, and then the switch of the plug unit 260 is turned on, so that the power is supplied to a corresponding outlet.

The above-described switches are paired with the plugs, and the main switch 230 and the switch unit 220 are formed of a bi-polar switch capable of connecting and disconnecting the positive and negative poles. In another embodiment of the present invention, the main switch 230 and the switch unit 220 may be formed of a uni-polar switch capable of connecting and disconnecting one of the positive and negative poles. The extended line 250 has a defined length.

Figure 5:
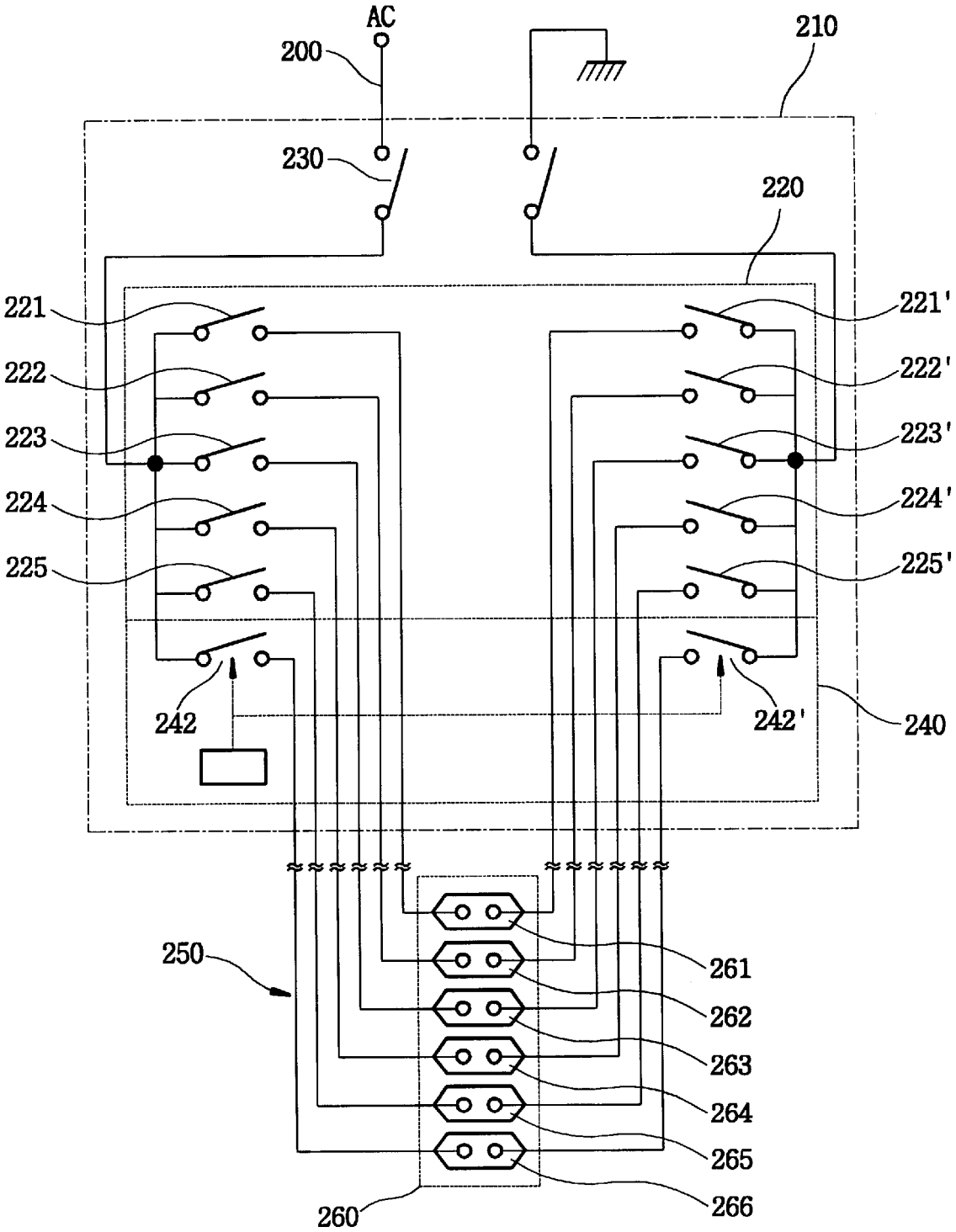
FIG. 5 is a schematic circuit diagram according to the present invention.

FIG. 5 is a view illustrating the circuitry of the power control apparatus according to the present invention.

As shown therein, one terminal of the main switch 230 of the switch box 210 is connected with the power AC in series, and the other end of the main switch 230 is parallel connected with one terminal of each of the switches 221, 222, 223, 224 and 225 of the switch unit 220 of the switch box 210.

The other end of each of the switches 221, 222, 223, 224 and 225 is connected in series with one terminal of each of the plugs 261, 262, 263, 264 and 265 of the plug unit 260, and the other end of each of the same is connected with the ground through the extended line 250.

The other terminal of each of the plugs 261, 262, 263, 264 and 265 is connected with a corresponding one of a plurality of negative switches 221', 222', 224', and 225', and the negative switches are connected with the negative switches of the main switch 230 and the negative power.

The operation will be explained. The user places the switch box 210 on the desk, and then the plug unit 260 is placed under the desk based on the extended line 250.

In this state, the switches 221 and 221' corresponding to the plug (for example, the plug 261) connected with the electrical appliance is turned on, and the power is applied to the plug 261 connected through the extended line 250.

At this time, even when the electrical appliance is connected with the plugs 262, 263, 264 and 265, since the switch 222, 223, 224, 225 and 222', 223', 224', 225' are disconnected, the power supply is completely disconnected, so that the power consumption and electrical wave discharge are prevented.

Namely, in the present invention, at least one switch among the main switch 230 and the switches of the switch unit 220 or the main switch 230 only is turned on/off by a timer switch 240. When the time set by a counter 241 of the timer switch 240 is elapsed, the switches 242 and 242' are turned on or off, so that the power supplied to the plug 266 through the extended line 250 is disconnected.

In addition, the power of the switch unit 220 is turned on or off at the time when the set time is elapsed in the case that the timer switch is adapted to the main switch.

Figure 6:
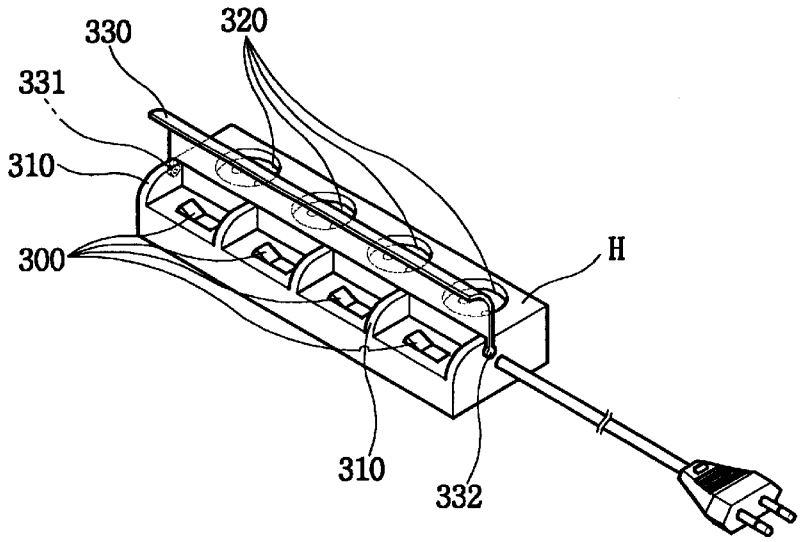
FIG. 6 is a perspective view illustrating a power control apparatus according to a third embodiment of the present invention.

FIG. 6 illustrates a third embodiment of the present invention. In this embodiment of the present invention, the power control apparatus includes a plurality of switches 300 for connecting or disconnecting the power to the ports 320. The switches 300 are separated from each other by a barrier formed between the neighboring switches.

The construction of the third embodiment of the present invention will be explained.

As shown in FIG. 6, the number of the switches 300 installed at a plane lower than the installation heights of the port 320 of the housing H correspond to the number of the ports 320.

In addition, the switches 300 are separated from each other by the neighboring switches and the barriers 310.

Namely, in this embodiment of the present invention, it is possible to prevent any changes of the set state due to an erroneous operation of the switch when turning on or off the neighboring switches. The height of each barrier is higher than that of the switches 300. Since the switches 300 are separated by the barriers 310, it is possible to prevent any erroneous operation of the switches 300.

For example, a user may touch the turned-on switch by a part of his body or clothes thereby turning off the switch, so that a corresponding electrical system is disconnected from the power supply.

A cover 330 is hingedly fixed at an upper portion or a side portion of the housing H by hinges 331 and 332 for protecting the switches 300.

Therefore, the switches 300 are separated from the outside, so that it is possible to implement a reliability of the set state by protecting any changes of the set state of the switches 300.

In the case that the entire space between the barriers 310 is not covered, and the cover 330 covers only the upper portion, the cover 330 is slightly opened, so that it is possible to change the on/off state of the switches 300.

Figure 7:
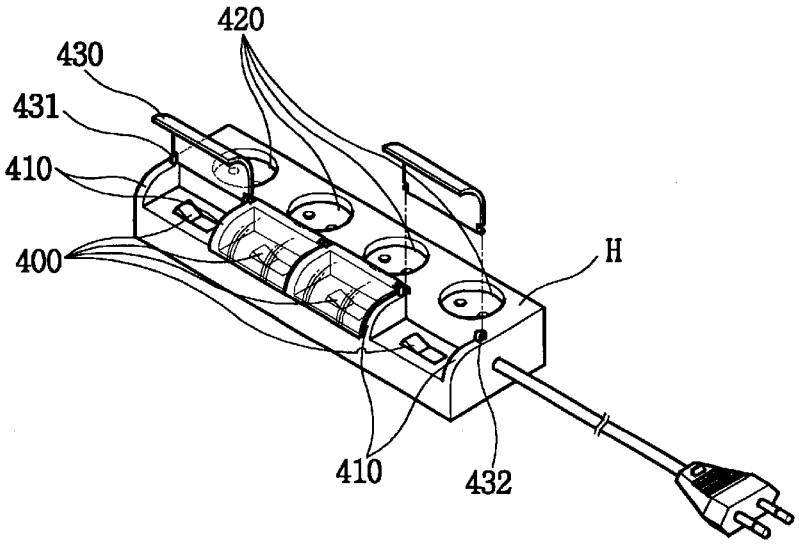
FIG. 7 is a perspective view illustrating an example of the third embodiment of the present invention.

FIG. 7 is a view illustrating another example of the third embodiment of the present invention. In this embodiment, the switches 400 are not covered by one cover. Namely, each of the switches 400 separated by the barriers 410 includes a cover 430. Therefore, the covers 430 are hingedly fixed at the upper portion of the barriers 410 using the hinges 431 and 432.

Namely, a corresponding switch cover is opened for changing the set state of the switch. Therefore, in this embodiment, it is possible to safely maintain a set state of the switch.

Figure 8:
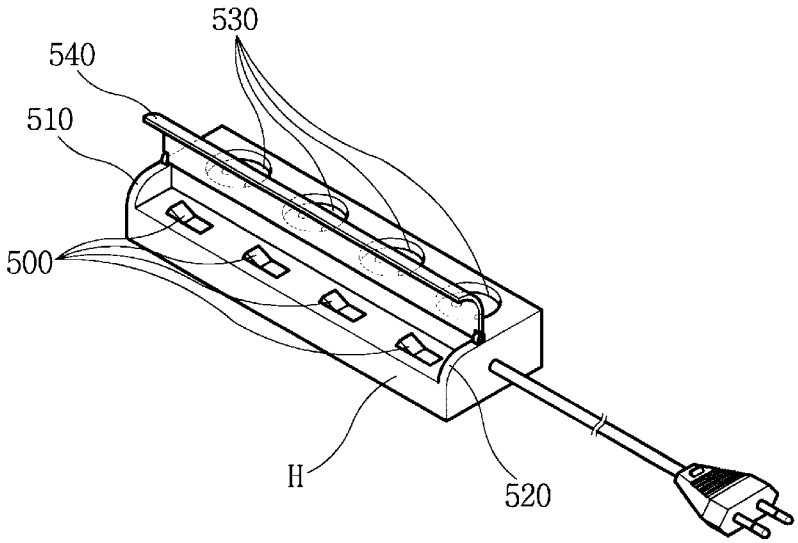
FIG. 8 is a perspective view illustrating another example of the third embodiment of the present invention.

FIG. 8 is a view illustrating another example of the third embodiment of the present invention. In this embodiment, the barrier 510 is formed so that the switches 500 are not separated. The switches are installed at the edge portions so that an external force is prevented.

At this time, the front portion which is opened to the outside and the upper portion are protected by the cover 540, and the switches 500 are separated from each other, so that it is possible to implement a stable on/off state of the switch.

Figure 9:
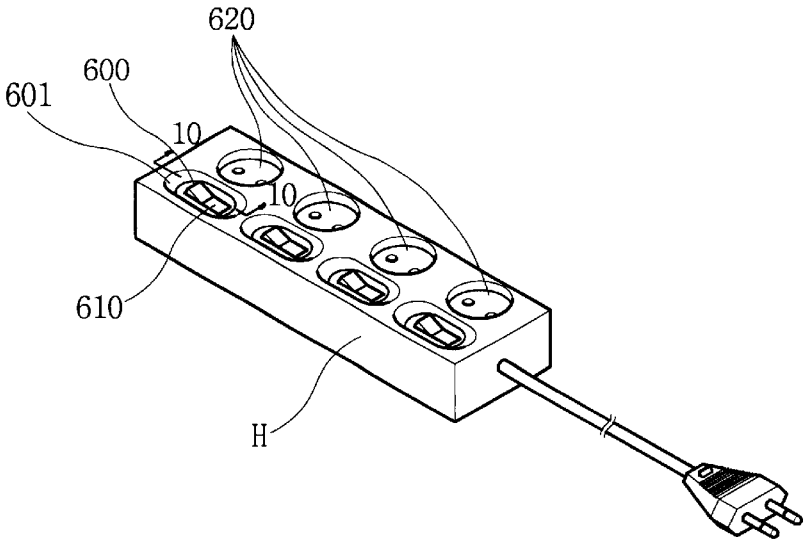
FIG. 9 is a perspective view illustrating a power control apparatus according to a fourth embodiment of the present invention.

FIG. 9 is a view illustrating a fourth embodiment of the present invention. As shown therein, the power control apparatus includes a plurality of switches 610 for connecting or disconnecting the power to a plurality of ports 620.

The switches 610 are installed at a groove 600 having a certain depth at the housing H.

The groove 600 has at least one slanted surface.

The construction of the fourth embodiment of the present invention will be explained with reference to FIG. 9.

A groove 600 is formed at the housing H for installing the switches 610 therein, and the switches 610 are installed to correspond with the ports 620.

In addition, the groove 600 is formed to have the same height as the switches 610 or to have a certain depth deeper than the heights of the switches 610.

Figure 10:
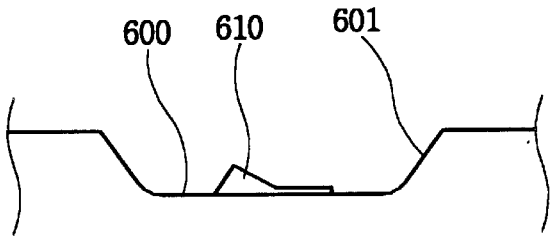
FIG. 10 is a cross-sectional view taken along line 10—10 of FIG. 9.

FIG. 10 is a view taken along the line 10—10 of FIG. 9. As shown therein, the switches 610 are installed at the groove 600 formed at the housing H. At least one surface of the groove 600 has a slanted surface. In the drawing, two side surfaces are slanted.

The slanted portion 601 is formed for easily changing the on/off state of the switch 610.

Namely, each side surface or at least one side surface of the groove 600 is slanted for implementing an easier on/off operation of the switch 610.

Figure 11:
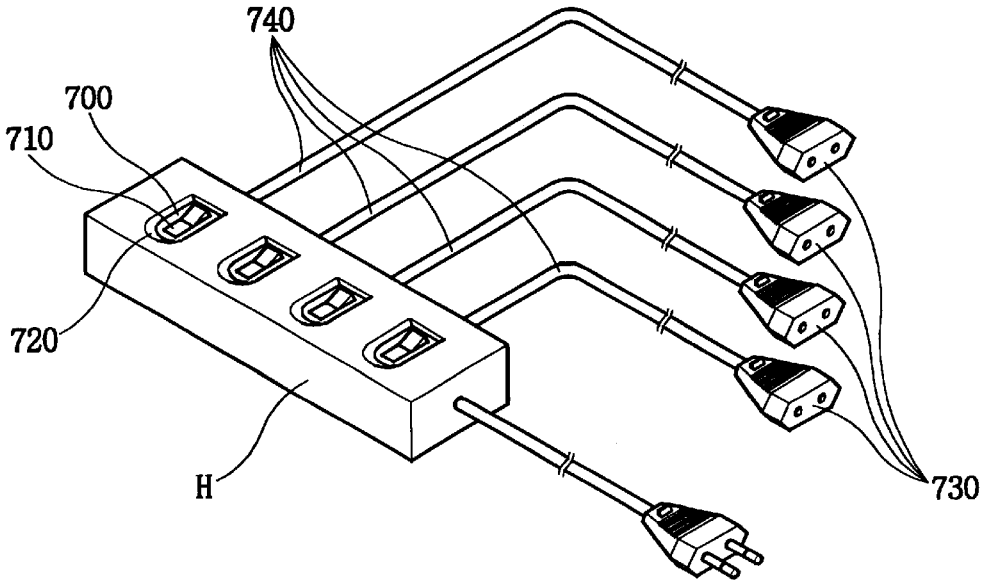
FIG. 11 is a perspective view illustrating an example of the fourth embodiment of the present invention.

FIG. 11 is a view illustrating another example of the fourth embodiment of the present invention. The power control apparatus according to the present invention includes a switch box H having a plurality of switches 710, and a plurality of plugs 730 spaced-apart at regular intervals by the extended line 740 from the switch box H.

Each switch 710 is installed at a groove formed at the switch box. In addition, the groove has at least one slanted surface.

The switch box H includes switches 710 for supplying power to the plugs 730. The plugs 730 are uniformly spaced and are connected with the lines 740. The switches 710 are installed at grooves 700 formed at the switch box H, and the grooves 700 have at least one slanted portion 720. At least one surface of the groove 700 is formed to have a slope for implementing an easier on/off operation of the switch 710.

Figure 12:
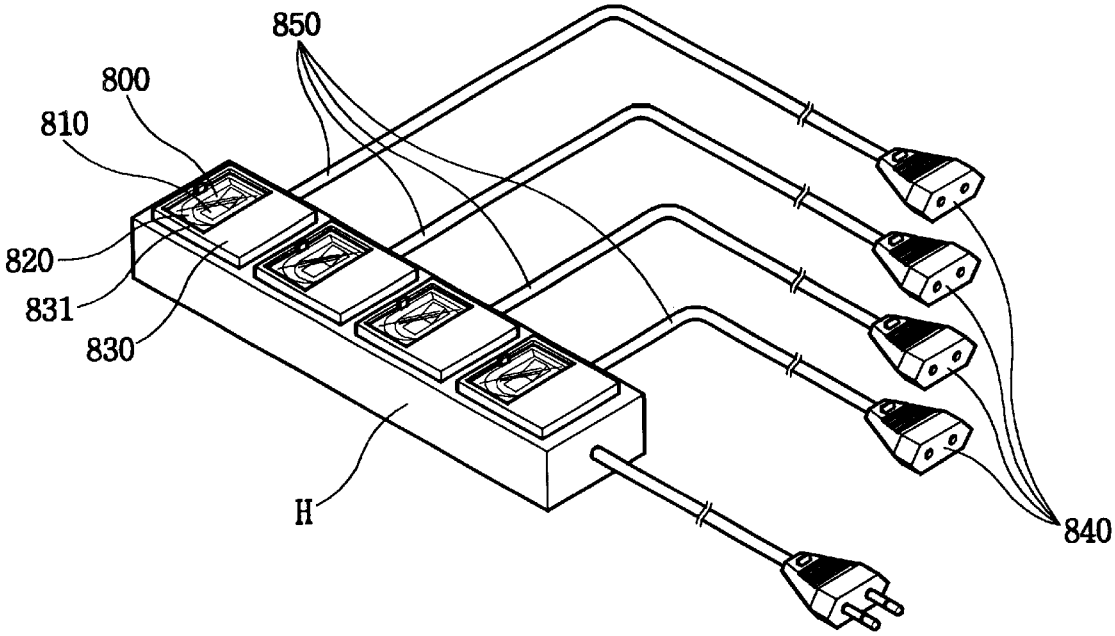
FIG. 12 is a perspective view illustrating another example of the fourth embodiment of the present invention.

FIG. 12 is another example of the third embodiment of the present invention. As shown therein, in order to prevent any changes of the set state of the switch 810 installed at the groove 800, a slide cover 820 is installed at the upper portion thereof. In addition, a hiding portion 830 is formed at a portion in which the groove 800 is not formed for hiding the cover 820 at the upper portion of the housing H.

In addition, the cover 820 slides along the guide 831 formed at the hiding portion 830. The hiding portion 830 and the guide 831 do not protrude from the upper portion of the housing H and are hidden in the side portion of the groove 800.

Figure 13:
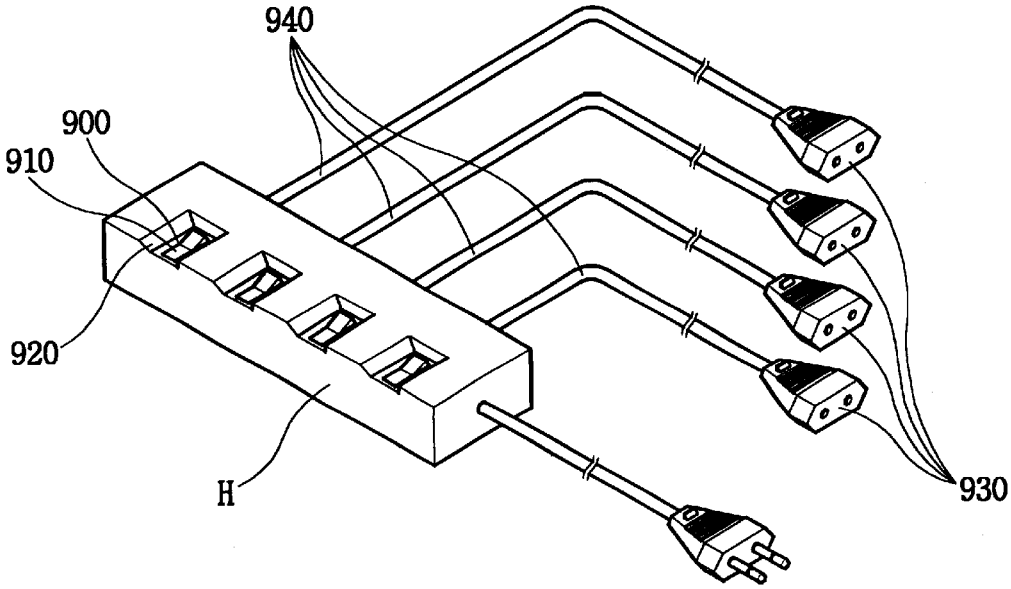
FIG. 13 is a perspective view illustrating another example of the fourth embodiment of the present invention.

FIG. 13 is a view illustrating another example of the fourth embodiment of the present invention. The power control apparatus according to the present invention includes a switch box H having a plurality of switches 910 and a plurality of plus 930 extended by the lines 940 and spaced-apart at a regular distance. The switches 910 are installed at grooves 900 having one side of a defined depth and an open side at the switch box H. Each side surface of the groove 900 includes a slanted portion.

The switch box H includes a plurality of switches for supplying the power to the plugs 930. The plugs 930 are spaced-apart at a regular distance, so that the power is supplied to the plugs 930 based on the on/off operations of the switches 910.

The switches 910 are installed at the groove 900 formed at the switch box H. The upper and front portions of the groove 900 are opened, so that a user uses fingers to easily turn on/off the switches 910.

In addition, each groove 900 has a certain height higher than that of the switch 910, and a side portion of the groove 900 has a slanted portion, so that a user can easily use fingers to turn on/off the switches.

The present invention has the following advantages.

First, a plurality of switches are installed at the power control apparatus which has a plurality of integrated plugs, so that it is possible to separately and selectively supply the power to a corresponding plug, whereby power consumption and electrical waves are minimized.

Second, the plugs are extended at a certain distance from the switches using lines, so that the power line of the electrical appliance is hidden. Only the switches are exposed to the outside. Therefore, a good outer appearance is obtained. In addition, the plugs of the power control apparatus are out of the reach of the children, so that it is possible to prevent any electrical accident.

Third, in the case that the user does not wish to change the set states of the switches, namely, in the case that the on/off states of the switches are not changed, the stable set states of the switches are obtained, so that it is possible to implement a reliability of the set states of the switches.

What is claimed is:

1. A power control apparatus for directing an electrical power from a power source to a selected electrical appliance, comprising:

a switch box including a plurality of activating switches for supplying power to a selected electrical appliance and including a main switch for controlling the flow of power to the switches;

means for supplying power connected directly to the switch box and to the main switch without any intervening electrical outlets; and a plurality of conductor lines, each connected individually within the switch box to a respective one of the plurality of the switches and extending from the switch box, the ends of the conductor lines having connecting holes for a direct connection to the electrical appliance without any intervening switches;

the switches and conductor lines being integrally formed with the switch box.

2. A power control apparatus as in claim 1, including a plurality of outlets formed in the switch box, each connected individually to a respective one of the plurality of the switches within the switch box, each outlet being connectable directly to a selected one of electrical appliances without any intervening switches;

the switches and conductor lines being integrally formed with the switch box.

3. The apparatus of claim 2, further comprising a timer switch for turning on/off the individual switches or the main switch based on a set time.

4. A power control apparatus as in claim 1, including a plurality of plugs coupled to said conductor lines; and barriers for separating said switches; wherein said plurality of switches are integrally formed in one housing;

the plurality of the switches each being separated by a barrier formed between the neighboring switches.

5. The apparatus of claim 4, further comprising a cover hinged at the housing for separating the switches from the ambient environment.

6. The apparatus of claim 5, wherein said covers are provided in a multiple number to correspond to the number of the switches.

7. A power control apparatus as in claim 4, wherein each of the switches is installed at a groove having a cdefined height formed in the housing.

8. The apparatus of claim 7, wherein said groove includes at least one slanted surface.

9. A power control apparatus as in claim 7, wherein the plurality of the switches are installed at grooves having a defined depth at the switch box.

10. The apparatus of claim 9, wherein said grooves include a slidable cover at the upper portion.

* * * * *